US005390803A

United States Patent [19]

McAllister

[11] Patent Number: 5,390,803

[45] Date of Patent: Feb. 21, 1995

[54] REINFORCED SHELF

[75] Inventor: Larry N. McAllister, Dover, Del.

[73] Assignee: Metal Masters Food Service Equipment Co., Inc., Smyrna, Del.

[21] Appl. No.: 162,335

[22] Filed: Dec. 3, 1993

Related U.S. Application Data

[63] Continuation-in-part of Ser. No. 7,585, Apr. 27, 1993.

[51] Int. Cl.[6] ..... A47F 5/00

[52] U.S. Cl. ..... 211/153; 108/144; 211/181; 211/187; D6/511

[58] Field of Search ..... 211/153, 187, 181, 106, 211/90; 108/106, 107, 144; D6/511

[56] References Cited

U.S. PATENT DOCUMENTS

| | | | |
|---|---|---|---|
| D. 326,579 | 6/1992 | Leeds | D6/511 |
| 3,523,508 | 8/1970 | Maslow | 108/144 |
| 3,757,705 | 9/1973 | Maslow | 108/144 |
| 4,064,994 | 12/1977 | Ondvasik | 211/181 X |
| 4,250,815 | 2/1981 | Swanson | 108/144 X |
| 4,318,352 | 3/1982 | Friedman et al. | 108/144 X |
| 4,595,107 | 6/1986 | Welsch | 108/144 X |
| 4,627,543 | 12/1986 | Nicely | 108/144 X |
| 4,637,323 | 1/1987 | Nicely | 108/144 X |
| 4,656,952 | 4/1987 | Schweizer | 108/144 X |

*Primary Examiner*—Robert W. Gibson, Jr.
*Attorney, Agent, or Firm*—Connolly and Hutz

[57] ABSTRACT

A reinforced shelf mountable to spaced apart vertical support posts by a plurality of collars generally forming the corners of the shelf is provided. The shelf is formed by a plurality of transverse members, such as wires, attached, such as by welding, to a plurality of longitudinal members. The transverse members and longitudinal members at the outer edges of the shelf are connected to the collars. At the front edge of the shelf, a load bearing truss is provided that features (a) the longitudinal member; (b) a longitudinal bar, spaced apart from the longitudinal member, attached at its ends to the collars; (c) a serpentine member, having upper and lower bends, attached at its upper bends to the longitudinal member at the front edge of the shelf and at its lower bends to the longitudinal bar; and (d) a reinforcing bar attached at its ends to the collars and attached along its length at points of contact to the end portions of the transverse members. A similar load bearing truss preferably is provided additionally at the rear edge of the shelf.

4 Claims, 2 Drawing Sheets

REINFORCED SHELF

This application is a continuation-in-part of United States design patent application Ser. No. 29/007,585, filed Apr. 27, 1993, titled: Shelf.

BACKGROUND OF THE INVENTION

The present invention relates to reinforced shelves having corner collars with inner sleeves that are generally mounted onto upstanding support posts in such a manner that the shelves are supported in adjustable relation. The shelves may be assembled and adjusted without tooling.

Adjustable shelving is disclosed in prior patents, such as U.S. Pat. No. 3,757,705, wherein a frusto-conical sleeve is positioned at each corner of a wire shelf formed by longitudinally extending members and transversely extending members that have been welded together. Such corner sleeves have internal inwardly extending ridges or rims that engage grooves in upstanding support posts. The position of the sleeves, and the shelf, may be varied depending upon the post grooves selected to mate the sleeves. Additionally, the height of the posts may be adjusted upwardly or downwardly via adjustable feet threadedly associated with the posts. A snake-like frame surrounds the outer front, rear and side edges of the wire shelf. However, the wire shelves shown in this prior patent are not reinforced at the front edge by a longitudinal reinforcing bar attached along its length to the end portions of the transversely extending members and connected at each end to a corner collar.

Various other wire shelf unit designs are shown in the following patents: U.S. Pat. No. Des. 185,801; U.S. Pat. No. Des. 215,773; U.S. Pat. Nos. Des. 289,479; 3,138,123; 3,208,408; 3,316,864; 3,225,720; 3,424,111; 3,523,508; 4,991,725 and 5,221,014. None of these patents, however, discloses a shelf reinforced at the front edge by a longitudinal reinforcing bar attached along its length to the end portions of the transversely extending members and connected at each end to a corner collar.

SUMMARY OF THE INVENTION

The present invention is a reinforced shelf mountable to spaced apart vertical support posts by a plurality of collars with inner sleeves generally forming the corners of the shelf. Preferably, the shelf is a wire shelf formed by a plurality of transverse members, such as metal wires, defining an object carrying surface, held together by contact with a plurality of longitudinal members, which also may be formed from metal wires. The shelf has at least two longitudinal members, one at or near the front edge and one at or near the rear edge of the shelf. The transverse members at the side outer edges and longitudinal members at the front and rear outer edges of the shelf are connected at their ends to the collars.

At each of the side edges of the shelf, a load bearing truss is formed by the side outer transverse member and a transverse bar, spaced apart from and generally parallel to the transverse member, and a serpentine member having upper and lower bends. The transverse member is attached at its ends to the corner collars. The transverse bar also is attached at its ends to the corner collars. The serpentine member is substantially connected at the top of its upper bends to the transverse member and at the bottom or outside of its lower bends to the transverse bar. Together the transverse member, the transverse bar and the serpentine member form the load bearing truss to support the side edge of the shelf and the carrying surface of the shelf.

At the front edge of the shelf, a reinforced load bearing truss is formed by the front longitudinal member, which is attached along its length to the end portions of the transverse members and attached at its ends to the collars, a longitudinal bar that is spaced apart from and generally parallel to the longitudinal member, a serpentine member having upper and lower bends, and a reinforcing bar. The longitudinal bar also is attached at its ends to the collars. The serpentine member is substantially connected at the top of its upper bends to the underside of the longitudinal member and at the bottom or outside of its lower bends to the longitudinal bar. The reinforcing bar is attached along its length to the end portions of the transverse members and attached at its ends to the collars. The longitudinal member, longitudinal bar, serpentine member and reinforcing bar together form the reinforced load bearing truss that supports the front edge of the shelf and the carrying surface of the shelf. Because the reinforcing bar will generally be attached along its length to the upper surfaces of the end portions of the transverse members, it also substantially prevents objects supported on the carrying surface from sliding off that surface at the front edge of the shelf.

Preferably, a reinforced load bearing truss like that at the front edge is provided also at the rear edge of the shelf according to the invention. In alternate embodiments, additional reinforced load bearing trusses may be provided also longitudinally in the central portion of the shelf to further support the shelf carrying surface.

DESCRIPTION OF THE PREFERRED EMBODIMENT

Figure 1:
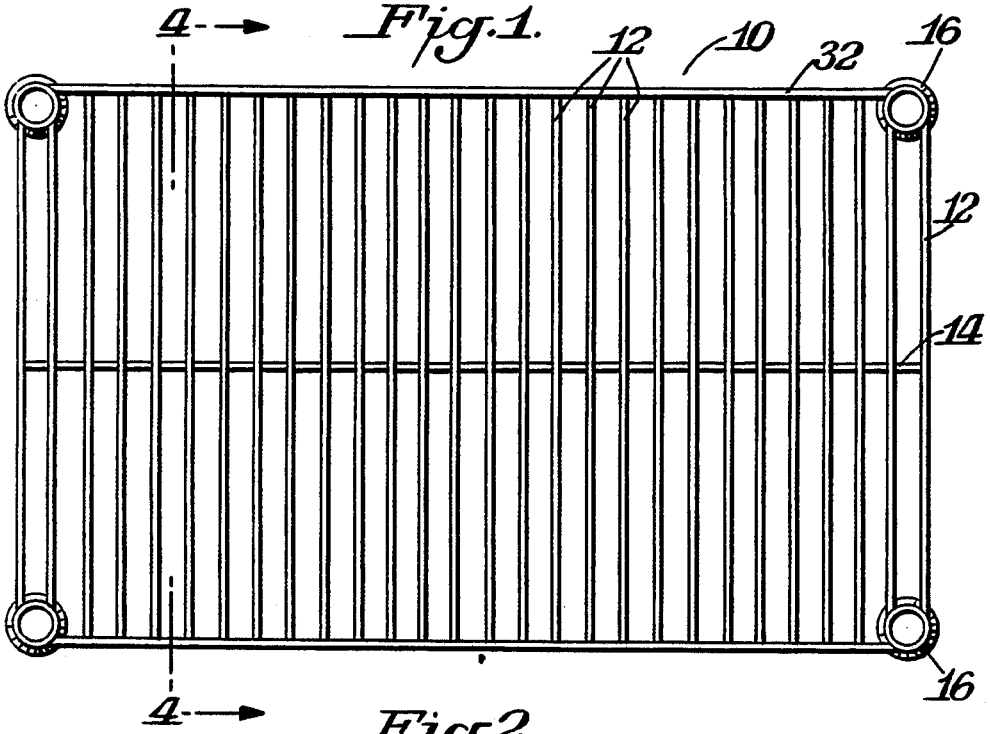
FIG. 1 is a top plan view of a shelf according to the present invention.

Referring to FIG. 1, the shelf 10 has an object carrying surface formed by a plurality of transverse members 12 spaced apart from one another in generally parallel relation to form a plane. A plurality of longitudinal members 14 are attached, by spot welding, adhesive or other fastening technique, along their length at points of connection to the transverse members 12. The end portions of one or more transverse members 12 at the side edges of the shelf 10 are each attached or connected, such as by welding, to generally frustoconical collars 16 at the outer surfaces of said collars 16. In the shelf 10 shown in FIG. 1, at each side edge of the shelf 10 two transverse members 12 are so attached or connected to each of the collars 16. The end portions of the longitudinal members 14 at the front and rear edges of the shelf 10 are each attached or connected, such as by welding, to collars 16 at the outer surfaces of said collars 16. A generally rectangular shelf 10 is thus formed having a collar 16 positioned at each corner.

The shelf according to the invention is generally rectangular in shape and has four identical corner structures. It is within the scope of this invention, however, for the shelf to have other shapes, such as a square or other four-sided figure, or a triangle, or similar geometric shapes.

Figure 3:
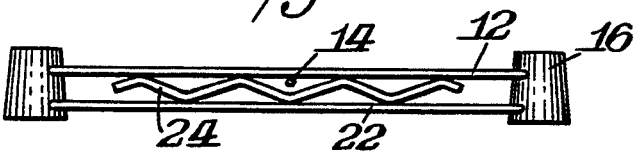
FIG. 3 is an end elevational view thereof.

Referring next to FIG. 3, a support truss structure is formed at or near each of the side edges of the shelf 10. The support truss structure at each side edge is identical so that for present purposes only one such structure shall be described. A transverse bar 16, spaced apart from the transverse member 12 at the side edge and generally parallel thereto, is connected or attached, such as by welding, at each end to a collar 16. A serpentine member 24 has upper bends and lower bends, with the top surfaces of the upper bends attached, such as by welding, along the length of the transverse member 12, and the lower bends attached, such as by welding, along the length of the transverse bar 22. Optionally, the ends of the serpentine member 24 may be attached or connected to corner collars 16 (not shown in FIG. 3).

Figure 2:
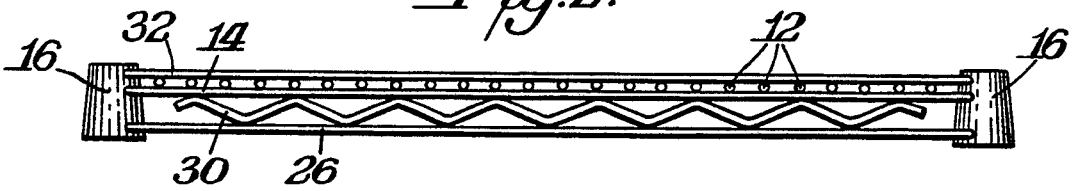
FIG. 2 is a side elevational view thereof.
Figure 4:
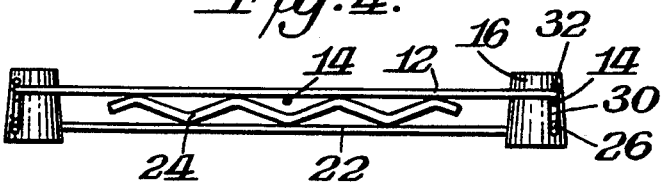
FIG. 4 is a cross-sectional view thereof taken along line 4—4 of FIG. 1.
Figure 6:
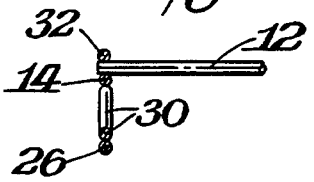
FIG. 6 is a fragmentary cross-sectional view of the shelf taken along the line 6—6 of FIG. 5.

A reinforced support truss structure according to the invention is shown in FIGS. 2 and 4 (See also FIG. 6). At the front edge of the shelf be a longitudinal member 14 is attached, such as by welding, along its length to the end portions 28 of the transverse members 12. As shown in FIGS. 1, 2 and 4, the longitudinal member 14 is attached to the lower surfaces of the transverse members 12 at the front edge of the shelf 10. A longitudinal bar 12, spaced apart from and generally parallel to the longitudinal member 14, is connected or attached at each end to the outer surface of a collar 16. A serpentine member 30, similar to the serpentine member 24, has upper and lower bends. The upper bends of the serpentine member 30 are attached, such as by welding, along the length of the longitudinal member 14 and the lower bends of the serpentine member 30 are attached to the length of the longitudinal bar 26. A reinforcing bar 32 is attached, such as by welding, along its length to the end portions 28 of the transverse members 12 and at each end to the outer surface of a collar 16.

The combination of reinforcing bar 32, longitudinal member 14, longitudinal bar 26 and serpentine member 30 forms a reinforced support truss structure for the transverse members 12. A shelf having such a reinforced support truss structure surprisingly has increased load bearing and improved static load deflection values over known shelves without such structure. In addition, the reinforcing bar 32 functions as a guide or rail to preclude objects held on the carrying surface of the shelf 10 from sliding off the carrying surface at the front edge of the shelf 10.

Preferably, as shown in FIGS. 1, 2 and 4, the reinforced support truss structure is provided at the front and rear edges of the shelf 10.

The transverse members 12 preferably are formed from 0.1483" diameter (9 guage) steel wire, the longitudinal members 14 from 0.192" diameter (6 guage) wire, and the longitudinal bar 26 from 0.250" diameter (2 guage) wire. The preferred wire material is steel that may be coated with zinc, chrome or an epoxy.

Figure 5:
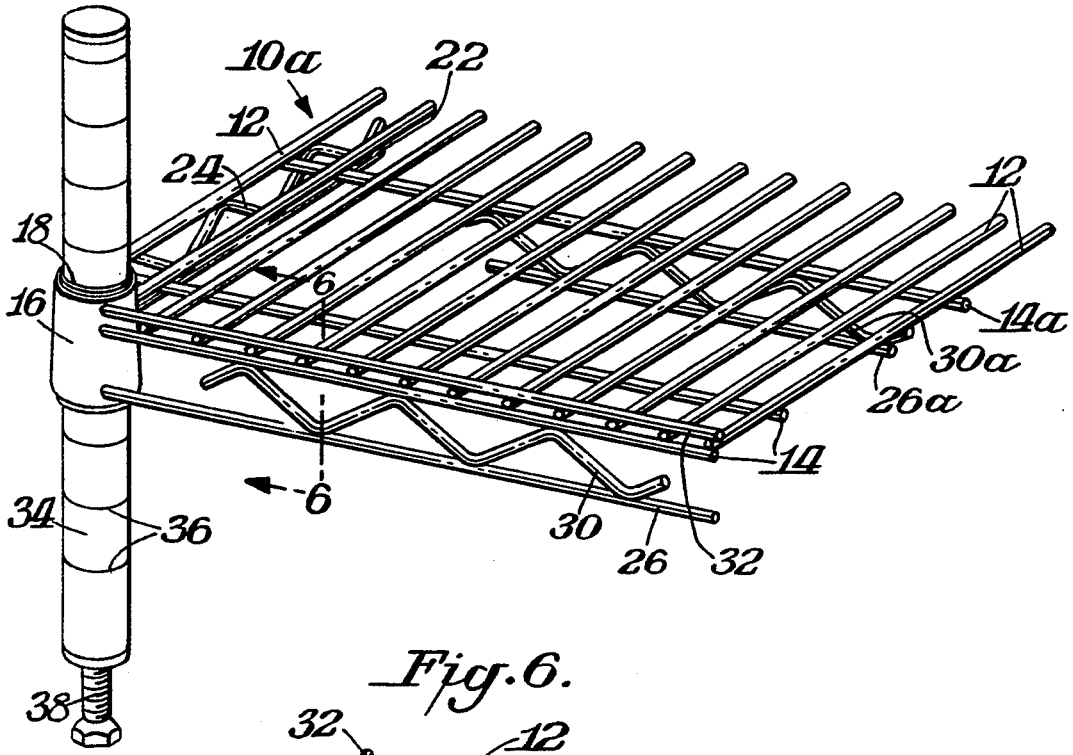
FIG. 5 is a partial perspective view of an alternate embodiment of the shelf according to the present invention, showing the corner sleeve of such shelf attached to a support post.

Referring next to FIG. 5, another embodiment of the shelf **10*a*, shown in partial perspective, has a corner collar 16 mounted on a vertical support post 34. The post 34, preferably of 1" outer diameter, is provided with a plurality of generally equally spaced annular grooves 36 axially separated from one another. A frusto-conical inner sleeve 18 shown in FIG. 5, surrounds the post 34. The inner surface of the sleeve 18 is provided with an internal radially-inwardly projecting ridge or rim (not shown) that engages an annular groove 36 of the post 34. The collar 16, mounted over the post 34 and sleeve 18, frictionally engages the sleeve 18 to hold the corner of the shelf 10*a* and the shelf carrying surface at the selected height. If adjustment of the height of the carrying surface is desired, with the collar 16 taken off the sleeve 18 and post 34, the sleeve be may be moved to another axial position on the post 34 to engage another annular groove 36. The collar 16 may then be re-mounted over the post 34 and sleeve 18**.

The vertical support post 34 may be provided with a threaded foot 38. By rotating the threaded foot, the vertical height of the post 34 may be slightly adjusted. This feature is particularly advantageous where the shelving system is to be installed on an uneven floor or other uneven support surface.

As further shown in FIG. 5, additional support truss structures may be provided to further support the carrying surface of the shelf **10*a*. A longitudinal member 14*a* is attached, such as by welding, along its length to the transverse members 12 at a position other than at the front or rear edge of the carrying surface of the shelf. A longitudinal bar 26*a* is spaced apart from and generally parallel to the longitudinal member 14*a*. The ends of the longitudinal bar are attached either to the serpentine members 24 or to the transverse bars 22 at the side edges of the shelf 10. A serpentine member 30*a* having upper and lower bends is attached, such as by welding, at its upper bends to the longitudinal member 14*a* and at its lower bends to the longitudinal bar 26*a***.

EXAMPLE

Static load deflection values for the shelves according to the embodiment of the invention shown in FIGS. 1–4 were compared with values obtained for shelves of the same carrying surface length and width dimensions according to the prior art, such as those shown in U.S. Pat. Nos. 3,424,111, 3,523,508 and 3,757,705, sold by Inter-Metro Industries Corp. of Wilkes Barre, Pa.

The procedure for the test was as follows: A 1" by 6" wide flat aluminum bar was placed on top the shelf so that the bar overlapped the front and rear edges of the shelf. Two separate static load deflection values were measured for each shelf. First, a weight of 600 pounds was placed on the flat bar in the center of the shelf and deflection in inches was measured. Next, a weight of 800 pounds was placed on the flat bar in the center of the shelf and deflection was again measured. The deflection values obtained for the shelf according to the invention were then compared to those obtained for the prior art. The results are reported in the table below:

TABLE I

STATIC LOAD DEFLECTION TEST RESULTS

| Shelf Size | Weight (lbs) | Prior art Deflection (inches) | Invention Deflection (inches) | Percent Increase in Strength |
|---|---|---|---|---|
| 18 × 36" | 600 | .191 | .168 | 12 |
| | 800 | .254 | .229 | 10 |
| 18 × 48" | 600 | .371 | .357 | 4 |
| | 800 | .548 | .455 | 17 |
| 18 × 60" | 600 | .833 | .622 | 25 |
| | 800 | 1.063 | .887 | 17 |
| 24 × 36" | 600 | .154 | .148 | 4 |
| | 800 | .259 | .193 | 26 |
| 24 × 48" | 600 | .419 | .394 | 6 |

TABLE I-continued

STATIC LOAD DEFLECTION TEST RESULTS

| Shelf Size | Weight (lbs) | Prior art Deflection (inches) | Invention Deflection (inches) | Percent Increase in Strength |
|---|---|---|---|---|
| | 800 | .535 | .508 | 5 |
| 24 × 60" | 600 | .693 | .636 | 8 |
| | 800 | .947 | .845 | 11 |

As is clear from the results reported in Table I, the shelves of the invention having a reinforced support truss structure surprisingly have increased load bearing and improved static load deflection values over known shelves without such structure.

The description of the preferred embodiments are provided merely for purposes of explanation and illustration. Various modifications to the embodiments described above may be made by those of skill in the art without departing from the scope of the present invention as set forth in the following claims.

I claim:

1. A reinforced shelf for carrying objects, mountable to at least two spaced apart vertical support posts for the shelf, comprising:

a plurality of collars connectable to the support posts;

a plurality of transverse members forming an object carrying surface for carrying objects to be placed on the shelf, the carrying surface defining a front edge and a rear edge and side edges, with at least one transverse member positioned at each side edge and connected to one or more of said collars;

a plurality of longitudinal members substantially attached at points of contact to the transverse members with at least one longitudinal member positioned below the transverse members at the front edge and connected to one or more of said collars;

a longitudinal bar, spaced apart from and substantially parallel to the longitudinal member at the front edge of the carrying surface, and connected to one or more of said collars;

a serpentine member having upper and lower bends, the serpentine member being substantially attached at the point of contact of each upper bend to the longitudinal member at the front edge of the carrying surface and substantially attached at the point of contact of each lower bend to the longitudinal bar at the front edge of the carrying surface; and a reinforcing bar, positioned near or at the front edge and above the carrying surface and substantially attached at points of contact to the transverse members, and connected to one or more of said collars, wherein the reinforcing bar, the longitudinal member, the longitudinal bar and the serpentine member in combination form a load supporting truss for the carrying surface at the front edge of the carrying surface.

2. The reinforced shelf of claim 1, further comprising:

a second longitudinal bar, spaced apart from and substantially parallel to the longitudinal member at the rear edge of the carrying surface, and connected to one or more of said collars;

a second serpentine member having upper and lower bends, the second serpentine member being substantially attached at the point of contact of each upper bend to the longitudinal member at the rear edge of the carrying surface and substantially attached at the point of contact of each lower bend to the longitudinal bar at the rear edge of the carrying surface; and a second reinforcing bar, positioned near or at the rear edge and above the carrying surface and substantially attached at points of contact to the transverse members, and connected to one or more of said collars, wherein the second reinforcing bar, the longitudinal member, the second longitudinal bar and the second serpentine member in combination form a load supporting truss for the carrying surface at the rear edge of the carrying surface.

3. The reinforced shelf of claim 2, further comprising:

a transverse bar spaced apart from and generally parallel to the transverse member at one side edge of the carrying surface and connected to one or more of said collars; and an additional serpentine member having upper and lower bends, wherein the additional serpentine member is substantially attached at points of contact between each upper bend and the transverse member at one side edge of the carrying surface and substantially attached at points of contact between each lower bend and the transverse bar at that one side edge of the carrying surface.

4. The reinforced shelf of claim 1 in combination with the vertical support posts to form a shelving system.

* * * * *